US009688938B2

(12) United States Patent
Desantis et al.

(10) Patent No.: US 9,688,938 B2
(45) Date of Patent: Jun. 27, 2017

(54) LUBRICAN COMPOSITION COMPRISING ACYCLIC HINDERED AMINES

(71) Applicant: BASF SE, Ludwigshafen (DE)

(72) Inventors: Kevin J. Desantis, Upper Nyack, NY (US); Michael Hoey, Maplewood, NJ (US); Bjoern Ludolph, Ludwigshafen (DE); Matthias Kiefer, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 64 days.

(21) Appl. No.: 14/421,000

(22) PCT Filed: Aug. 14, 2013

(86) PCT No.: PCT/US2013/054929

§ 371 (c)(1),
(2) Date: Feb. 11, 2015

(87) PCT Pub. No.: WO2014/028609

PCT Pub. Date: Feb. 20, 2014

(65) Prior Publication Data

US 2015/0210956 A1 Jul. 30, 2015

Related U.S. Application Data

(60) Provisional application No. 61/682,883, filed on Aug. 14, 2012, provisional application No. 61/682,882, filed on Aug. 14, 2012, provisional application No. 61/682,884, filed on Aug. 14, 2012.

(51) Int. Cl.

| | |
|---|---|
| ***C10M 133/06*** | (2006.01) |
| ***C10M 133/40*** | (2006.01) |
| ***C10M 163/00*** | (2006.01) |

(52) U.S. Cl.

CPC ..... *C10M 133/40* (2013.01); *C10M 133/06* (2013.01); *C10M 163/00* (2013.01); *C10M 2203/1006* (2013.01); *C10M 2203/1025* (2013.01); *C10M 2205/0285* (2013.01); *C10M 2207/026* (2013.01); *C10M 2215/042* (2013.01); *C10M 2215/064* (2013.01); *C10M 2215/08* (2013.01); *C10M 2215/221* (2013.01); *C10M 2215/28* (2013.01); *C10N 2220/021* (2013.01); *C10N 2230/36* (2013.01); *C10N 2240/10* (2013.01); *C10N 2270/02* (2013.01)

(58) Field of Classification Search

CPC C10M 133/06; C10M 133/40; C10M 163/00; C10M 2203/1006; C10M 2203/1025; C10M 2205/0285; C10M 2207/026; C10M 2215/042; C10M 2215/064; C10M 2215/08; C10M 2215/221; C10M 2215/28; C10N 2220/021; C10N 2230/36; C10N 2240/10; C10N 2270/02

USPC ..... 508/545

See application file for complete search history.

(56) References Cited

U.S. PATENT DOCUMENTS

| | | | | |
|---|---|---|---|---|
| 3,398,197 | A * | 8/1968 | Miller et al. | B03D 1/01 252/60 |
| 4,231,883 | A | 11/1980 | Malec | |
| 4,512,903 | A | 4/1985 | Schlicht et al. | |
| 4,692,256 | A | 9/1987 | Umemura et al. | |
| 4,764,298 | A | 8/1988 | Croudace | |
| 4,795,583 | A | 1/1989 | Papay | |
| 4,857,595 | A | 8/1989 | Kazmierzak et al. | |
| 4,927,562 | A * | 5/1990 | Karol | C08F 8/00 508/260 |
| 5,073,278 | A | 12/1991 | Schumacher et al. | |
| 5,143,634 | A | 9/1992 | Quinga et al. | |
| 5,198,130 | A | 3/1993 | Schumacher | |
| 5,202,038 | A | 4/1993 | Schoch et al. | |
| 5,268,113 | A | 12/1993 | Evans | |
| 5,518,510 | A | 5/1996 | Daly et al. | |
| 5,681,798 | A | 10/1997 | Farng et al. | |
| 5,798,319 | A * | 8/1998 | Schlosberg | C07C 69/44 507/100 |
| 6,004,910 | A | 12/1999 | Bloch et al. | |
| 6,649,575 | B2 | 11/2003 | Robson | |
| 6,793,696 | B2 | 9/2004 | Krull et al. | |
| 7,875,579 | B2 | 1/2011 | Chase et al. | |
| 7,932,218 | B2 | 4/2011 | Chasan et al. | |
| 7,939,478 | B2 | 5/2011 | Mayhew et al. | |

(Continued)

FOREIGN PATENT DOCUMENTS

| | | |
|---|---|---|
| DE | 2 253 888 A1 | 5/1973 |
| DE | 10 337 901 A1 | 3/2005 |

(Continued)

OTHER PUBLICATIONS

International Search Report for Application No. PCT/US2013/054959 dated Jan. 2, 2014, 4 pages.

International Search Report for Application No. PCT/US2013/054959 dated Aug. 15, 2014, 3 pages.

Machine-Assisted English translation for DE 2 253 888 extracted from the espacenet.com database on Feb. 19, 2015, 28 pages.

English language abstract and machine-assisted English translation for DE 10 337 901 extracted from espacenet.com database on Feb. 19, 2015, 21 pages.

English language abstract for EP 0 356 677 extracted from espacenet.com database on Feb. 19, 2015, 1 page.

English language abstract and machine-assisted English translation for JP 2003-292982 extracted from the PAJ database on Feb. 19, 2015, 22 pages.

English language abstract and machine-assisted English translation for JP 2010-065134 extracted from the PAJ database on Feb. 19, 2015, 40 pages.

(Continued)

*Primary Examiner* — James Goloboy

(74) *Attorney, Agent, or Firm* — Howard & Howard Attorneys PLLC

(57) ABSTRACT

A lubricant composition including an acyclic amine compound. A method of lubricating a system including a fluoropolymer seal with the lubricant composition is also provided. An additive concentrate for a lubricant composition is also provided. The acyclic amine compound is useful for adjusting the total base number of a lubricant composition. The lubricant composition is compatible with fluoropolymer seals.

16 Claims, No Drawings

(56) References Cited

U.S. PATENT DOCUMENTS

| | | | |
|---|---|---|---|
| 8,093,190 | B2 | 1/2012 | Chase et al. |
| 8,143,201 | B2 | 3/2012 | Emert et al. |
| 2004/0094453 | A1 | 5/2004 | Lok et al. |
| 2004/0214733 | A1 | 10/2004 | Baba |
| 2006/0196807 | A1* | 9/2006 | Rosenbaum ..... C10M 111/04 208/19 |
| 2007/0072096 | A1 | 3/2007 | Takakuwa et al. |
| 2007/0105729 | A1 | 5/2007 | Hewette et al. |
| 2008/0051306 | A1 | 2/2008 | Chasan et al. |
| 2009/0111699 | A1 | 4/2009 | Negishi et al. |
| 2010/0190898 | A1 | 7/2010 | Negishi et al. |
| 2011/0077178 | A1 | 3/2011 | Chase et al. |
| 2011/0077182 | A1 | 3/2011 | Jukes |
| 2012/0101012 | A1 | 4/2012 | Delbridge et al. |
| 2012/0202728 | A1 | 8/2012 | Garcia Ojeda |
| 2012/0258896 | A1 | 10/2012 | Aguilar et al. |
| 2012/0329690 | A1 | 12/2012 | Truong-Dinh et al. |
| 2014/0024569 | A1 | 1/2014 | Bera et al. |

FOREIGN PATENT DOCUMENTS

| | | | |
|---|---|---|---|
| EP | 0 356 677 | A1 | 3/1990 |
| JP | 2005-146010 | A | 6/2005 |

OTHER PUBLICATIONS

English language abstract for WO 2011/073960 extracted from espacenet.com database on Feb. 19, 2015, 1 page.

Partial English language translation of Li et al., Lubricant Additives Chemistry and Applications, 1st Edition, Jul. 31, 2006, pp. 98, 99, 110 provided by CCPIT Patent and Trademark Law Office on Dec. 20, 2016.

Pubchem Database, "[2,2 6,6-Tetramethyl-4-(stearoyloxy)piperidinooxyl] radical structure", downloaded from https://pubchem.ncbi.nlm.nih.gov/image/fl.html?cid=100958062 on Dec. 5, 2016, 1 page.

English language abstract and machine-assisted English translation for JP 2005-146010 extracted from espacenet.com database on May 17, 2017, 25 pages.

* cited by examiner

LUBRICAN COMPOSITION COMPRISING ACYCLIC HINDERED AMINES

RELATED APPLICATIONS

This application is the National Stage of International Patent Application No. PCT/US2013/054929,filed on Aug. 14, 2013,which claims priority to all the advantages of U.S. Patent Application Nos. 61/682,883, 61/682,882 and 61/682,884, filed on Aug.14, 2012, the content of which is incorporated herein by reference.

FIELD OF THE INVENTION

The present invention generally relates to a lubricant composition. More specifically, the present invention relates to a lubricant composition including an acyclic amine compound, to a method of forming the lubricant composition, and to an additive concentrate for a lubricant composition.

BACKGROUND OF THE INVENTION

It is known and customary to add stabilizers to lubricant compositions based on mineral or synthetic oils in order to improve their performance characteristics. Antioxidants are one type of stabilizer of particular importance. Oxidative degradation of lubricant compositions play a significant role in combustion chambers of engines because of the presence of oxides of nitrogen which catalyze oxidation of the lubricant composition.

Some conventional amine compounds are effective stabilizers for lubricants. These conventional amine compounds may help neutralize acids formed during the combustion process. However, these conventional amine compounds are generally not employed in combustion engines due to their detrimental effects on fluoroelastomer seals.

SUMMARY OF THE INVENTION

The present invention provides a lubricant composition including a base oil and an acyclic amine compound. The acyclic amine compound has the formula (I):

(I)

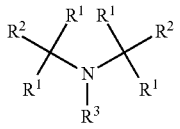

Each $R^1$ is independently selected from hydrogen and an alkyl group having from 1 to 17 carbon atoms, with at least two of $R^1$ being independently selected alkyl groups. Each $R^2$ is independently selected from an alcohol group, an alkyl group, an amide group, an ether group, and an ester group, each having from 1 to 17 carbon atoms. $R^3$ is selected from hydrogen and an alcohol group, an alkyl group, an amide group, an ether group, and an ester group, each having from 1 to 17 carbon atoms The present invention describes the stabilization of lubricant compositions with a certain class of amine compounds, the acyclic amine compound. Lubricant compositions including these amine compounds help neutralize acids formed during the combustion process.

DETAILED DESCRIPTION OF THE INVENTION

One aspect of a lubricant composition is the amount of basic material dispersed/dissolved within it, which is referred to as the Total Base Number ("TBN") of the lubricant composition. TBN is an industry standard measurement used to correlate the basicity of any material to that of potassium hydroxide. This value is measured by two ASTM titration methods, ASTM D2896 and ASTM D4739. Most TBN has been delivered by use of overbased metal soaps, but these soaps created problems with some newer engine technologies, such as diesel particulate filters. Formulations that minimize use of these metal soaps are of value and are referred to as "Low SAPS oils" (SAPS stands for Sulfated Ash, Phosphorus and Sulfur).

The requirements of the Low SAPS designation inherently restrict the amount of traditional calcium and magnesium based detergents found in the lubricant composition. These traditional detergents had many functions, including neutralization of acids formed during the combustion process and generated from the oxidation of a base oil in the lubricant composition. However, the limitation on the amount of these traditional calcium and magnesium based detergents that can be included has lowered the capacity of lubricant composition to neutralize acids. The decreased capacity of the lubricant composition to neutralize acids results in the need to change the lubricant composition more frequently.

The present invention provides a lubricant composition including a base oil and an acyclic amine compound. The present invention also provides a method of forming the lubricant composition and a method of lubricating a system with the lubricant composition. Further, the present invention provides an additive concentrate for lubricant compositions including the acyclic amine compound. The lubricant composition and these methods are described further below. The acyclic amine compound is useful for adjusting the total base number (TBN) of the lubricant composition. The acyclic amine compound is useful for other purposes as well, as described below.

The acyclic amine compound has the formula (I):

(I)

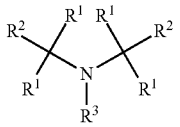

In formula (I), each $R^1$ is independently selected from hydrogen and an alkyl group having from 1 to 17 carbon atoms, with at least two of $R^1$ being independently selected alkyl groups. Alternatively, each $R^1$ may be independently selected from an alkyl group having from 1 to 12, 1 to 10, 1 to 8, or 1 to 6 carbon atoms. Each alkyl group designated by $R^1$ may be straight or branched. In formula (I), each $R^2$ independently selected from an alcohol group, an alkyl group, an amide group, an ether group, and an ester group, each having from 1 to 17 carbon atoms. Each $R^2$ may independently have from 1 to 15, 1 to 12, 1 to 8, 1 to 6, or 1 to 4 carbon atoms. Each group designated by $R^2$ may be straight or branched. $R^3$ is selected from hydrogen and an alcohol group, an alkyl group, an amide group, an ether group, and an ester group, each having from 1 to 17 carbon atoms. Alternatively, each $R^3$ may have from 1 to 10, 1 to 8, 1 to 6, or 1 to 4, carbon atoms. Each group designated by $R^3$ may be straight or branched.

At least two groups designated by $R^1$ are each independently selected alkyl groups. Alternatively, at least three, or exactly four groups, designated by $R^1$ of the acyclic amine compound, are independently selected alkyl groups.

In certain embodiments, at least one group designated by $R^1$, $R^2$, and $R^3$ is unsubstituted. Alternatively, at least two, three, four, five, or six groups designated by $R^1$, $R^2$, and $R^3$ are unsubstituted. By "unsubstituted," it is intended that the designated group is free from pendant functional groups, such as hydroxyl, carboxyl, oxide, thio, and thiol groups, and that the designated group is free from acyclic heteroatoms, such as oxygen, sulfur, and nitrogen heteroatoms. In other embodiments, every group designated by $R^1$, $R^2$, and $R^3$ is unsubstituted. Alternatively still, it is contemplated that one, two, three, four, five, or six groups designated by $R^1$, $R^2$, and $R^3$ are substituted. The term "substituted" indicates that the designated group includes at least one pendant functional group, such as a hydroxyl, carboxyl, oxide, thio, thiol group, and combinations thereof, or that the designated group includes at least one acyclic heteroatom, such as oxygen, sulfur, nitrogen, and combinations thereof.

Exemplary $R^1$, $R^2$, and $R^3$ groups may be selected from methyl, ethyl, n-propyl, n-butyl, sec-butyl, tert-butyl, n-hexyl, n-octyl, 2-ethylhexyl, n-nonyl, n-decyl, n-undecyl, n-dodecyl, n-tridecyl, n-tetradecyl, n-hexadecyl, and n-octadecyl groups.

The amine compound is acyclic. The term "acyclic" is intended to mean that the amine compound is free from any cyclic structures.

In one or more embodiments, the acyclic amine compound has a weight average molecular weight ranging from 100 to 1200. Alternatively, the acyclic amine compound has a weight average molecular weight ranging from 200 to 800, or from 200 to 600. The weight average molecular weight of the acyclic amine compound can be determined by several known techniques, such as gel permeation chromatography.

In one or more embodiments, the acyclic amine compound is non-polymeric. The term "non-polymeric" refers to the fact that the acyclic amine compound includes fewer than 50, 40, 30, 20, or 10 monomer units.

In one or more embodiments, the acyclic amine compound is free of phosphorous. Alternatively, it is also contemplated that the acyclic amine compound consists of nitrogen, hydrogen, and carbon atoms. Alternatively still, it is also contemplated that the acyclic amine compound consists of nitrogen, hydrogen, oxygen, and carbon atoms. Furthermore, it is also contemplated that the acyclic amine compound does not form a salt or complex with other components in the lubricant composition.

In one particular embodiment, the acyclic amine compound is selected from the group including:

N-tert-butyl-2-ethyl-N-methyl-hexan-1-amine:

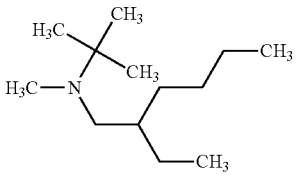

-continued tert-amyl-tert-butylamine:

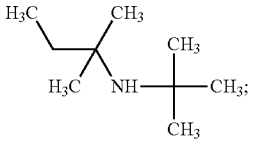

and

N-tert-butylheptan-2-amine:

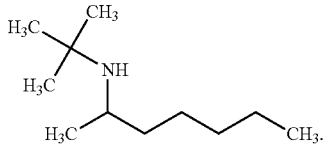

The acyclic amine compound is utilized in the lubricant composition in an amount ranging from 0.1 to 10 wt. % to form the lubricant composition Alternatively, the acyclic amine compound is utilized in the lubricant composition in an amount ranging from 0.5 to 5, or 1 to 3, wt. %, based on the total weight of the lubricant composition.

Alternatively, if the lubricant composition is formulated as an additive concentrate, the amine compound may be included in an amount ranging from 0.5 to 90, 1 to 50, 1 to 30, or 5 to 25, wt. %, based on the total weight of the additive concentrate.

Previous uses of conventional amine compounds involved forming a reaction product of such conventional amine compounds with various acids, oxides, triazoles, and other reactive components. In these applications, the conventional amine compounds are consumed by certain reactions such that the ultimately formed lubricant composition does not contain significant amounts of the conventional amine compound. In such conventional applications, more than 50 wt. % of the conventional amine compound is typically reacted in the lubricant composition with various acids based on the total weight of the conventional amine compounds. In contrast, the inventive lubricant compositions and inventive methods contain a significant amount of the acyclic amine compound in an unreacted state. The term "unreacted" refers to the fact that the unreacted portion of the acyclic amine compound does not react with any components in the lubricant composition. Accordingly, the unreacted portion of the acyclic amine compound remains in its virgin state when present in the lubricant composition before the lubricant composition has been used in an end-user application, such as an internal combustion engine.

In certain embodiments, at least 90 wt. % of the acyclic amine compound remains unreacted in the lubricant composition based on a total weight of the acyclic amine compound utilized to form the lubricant composition prior to any reaction in the lubricant composition. Alternatively, at least 95, 96, 97, 98, or 99, wt. %, of the acyclic amine compound remains unreacted in the lubricant composition based on a total weight of the acyclic amine compound prior to any reaction in the lubricant composition.

The phrase "prior to any reaction in the lubricant composition" refers to the basis of the amount of the acyclic amine compound in the lubricant composition. This phrase does not require that the acyclic amine compound reacts with other components in the lubricant composition, i.e., 100 wt. % of the acyclic amine compound may remain unreacted in the lubricant composition based on a total weight of the acyclic amine compound prior to any reaction in the lubricant composition.

In one embodiment, the percentage of the acyclic amine compound that remains unreacted is determined after all of the components which are present in the lubricant composition reach equilibrium with one another. The time period necessary to reach equilibrium in the lubricant composition may vary widely. For example, the amount of time necessary to reach equilibrium may range from a single minute to many days, or even weeks. In certain embodiments, the percentage of the acyclic amine compound that remains unreacted in the lubricant composition is determined after 1 minute, 1 hour, 5 hours, 12 hours, 1 day, 2 days 3 days, 1 week, 1 month, 6 months, or 1 year.

In certain embodiments, the lubricant composition includes less than 0.1, 0.01, 0.001, or 0.0001, wt. %, of compounds which would react with the acyclic amine compound based on the total weight of the lubricant composition. In certain embodiments, the lubricant composition may include a collective amount of acids, anhydrides, triazoles, and/or oxides which is less than 0.1 wt. % of the total weight of the lubricant composition. The term "acids" may include both traditional acids and Lewis acids. For example, acids include carboxylic acids, such as glycolic acid, lactic acid and hydracylic acid; alkylated succinic acids; alkylaromatic sulfonic acids; and fatty acids. Exemplary Lewis acids include alkyl aluminates; alkyl titanates; molybdenumates, such as molybdenum thiocarbamates and molybdenum carbamates; and molybdenum sulfides. "Anhydrides" are exemplified by alkylated succinic anhydrides and acrylates. Triazoles may be represented by benzotriazoles and derivatives thereof; tolutriazole and derivatives thereof; 2-mercaptobenzothiazole, 2,5-dimercaptothiadiazole, 4,4'-methylene-bis-benzotriazole, 4,5,6,7-tetrahydro-benzotriazole, salicylidenepropylenediamine, salicylamino-guanidine and salts thereof. Oxides may be represented by alkylene oxides, such as ethylene oxide and propylene oxide; metal oxides; alkoxylated alcohols; alkoxylated amines; or alkoxylated esters. Alternatively, the lubricant composition may include a collective amount of acids, anhydrides, triazoles, and oxides which is less than 0.01, 0.001, or 0.0001, wt. %, based on the total weight of the lubricant compositions. Alternatively still, the lubricant composition may be free of acids, anhydrides, triazoles, and oxides.

In yet another embodiment, the lubricant composition may consist, or consist essentially of a base oil and the acyclic amine compound. It is also contemplated that the lubricant composition may consist of, or consists essentially of, the base oil and the acyclic amine compound in addition to one or more of additives that do not compromise the functionality or performance of the acyclic amine compound. In various embodiments where the lubricant composition consists essentially of the base oil and the acyclic amine compound, the lubricant composition is free of, or includes less than 0.01, 0.001, or 0.0001, wt. %, of acids, anhydrides, triazoles, and oxides. In other embodiments, the terminology "consisting essentially of" describes the lubricant composition being free of compounds that materially affect the overall performance of the lubricant composition as recognized by one of ordinary skill in the art. For example, compounds that materially affect the overall performance of the lubricant composition may be described by compounds which negatively impact the TBN boost, the lubricity, the seal compatibility, the corrosion inhibition, or the acidity of the lubricant composition.

As described above, the acyclic amine compound improves the TBN of the lubricant composition. TBN is an industry standard measurement used to correlate the basicity of any material to that of potassium hydroxide. The value is reported as mg KOH/g and is measured according to ASTM D4739 for an individual additive. The TBN value of the acyclic amine compound is at least 70, at least 100, or at least 150 mg KOH/g of the acyclic amine compound.

In one embodiment, the lubricant composition derives at least 5%, at least 10%, at least 20%, at least 40%, at least 60%, at least 80%, or even 100% of the compositional TBN (as measured in accordance with ASTM D4739) from the amine compound. Furthermore, in certain embodiments, the lubricant composition includes an amount of the amine compound that contributes from 0.5 to 15, from 1 to 12, from 0.5 to 4, from 1 to 3, mg KOH/g of TBN (as measured in accordance with ASTM D4739) to the lubricant composition.

The lubricant composition may have a TBN value of at least 1 mg KOH/g of lubricant composition. Alternatively, the lubricant composition has a TBN value ranging from 1 to 15, 5 to 15, or 9 to 12 mg KOH/g of lubricant composition when tested according to ASTM D2896.

The acyclic amine compound is non-aggressive toward fluoroelastomer seals. The fluoroelastomer seals may be used in a variety of applications, such as o-rings, fuel seals, valve stem steals, rotating shaft seats, shaft seals, and engine seals. Fluoroelastomer seals may also be used in a variety of industries, such as automotive, aviation, appliance, and chemical processing industries. The fluoroelastomer is categorized under ASTM D1418 and ISO 1629 designation of FKM for example. The fluoroelastomer may include copolymers of hexafluoropropylene (HFP) and vinylidene fluoride (VDF of VF2), terpolymers of tetrafluoroethylene (TFE), vinylidene fluoride and hexafluoropropylene, perfluoromethylvinylether (PMVE), copolymers of TFE and propylene and copolymers of TFE, PMVE and ethylene. The fluorine content varies for example between 66 to 70% by weight based on the total weight of the fluoropolymer seal. FKM is fluoro-rubber of the polymethylene type having substituent fluoro and perfluoroalkyl or perfluoroalkoxy groups on the polymer chain.

The compatibility of the fluoroelastomer seal with the acyclic amine compound can be determined with the method defined in CEC-L-39-T96. Generally, conventional amines are very damaging to fluoroelastomer components. However, the inventive amine compounds show positive results with regards to compatibility with fluoroelastomer seals.

The CEC-L-39-T96 seal compatibility test is performed by submitting the seal or gaskets in the lubricant composition, heating the lubricant composition with the seal contained therein to an elevated temperature, and maintaining the elevated temperature for a period of time. The seals are then removed and dried, and the mechanical properties of the seal are assessed and compared to the seal specimens which were not heated in the lubricant composition. The percent change in these properties is analyzed to assess the compatibility of the seal with the lubricant composition. The incorporation of the amine compound into the lubricant composition decreases the tendency of the lubricant composition to degrade the seals, versus other amine compounds.

In certain embodiments, the base oil is selected from API Group I base oils, API Group II base oils, API Group III base oils, API Group IV base oils, API Group V base oils, and combinations thereof. In one embodiment, the base oil includes an API Group II base oil.

The base oil is classified in accordance with the American Petroleum Institute (API) Base Oil Interchangeability Guidelines. In other words, the base oil may be further described as including one or more of five types of base oils:

Group I (sulphur content >0.03 wt. %, and/or <90 wt. % saturates, viscosity index 80-119); Group II (sulphur content less than or equal to 0.03 wt. %, and greater than or equal to 90 wt. % saturates, viscosity index 80-119); Group III (sulphur content less than or equal to 0.03 wt. %, and greater than or equal to 90 wt. % saturates, viscosity index greater than or equal to 119); Group IV (all polyalphaolefins (PAO's)); and Group V (all others not included in Groups I, II, III, or IV).

The base oil typically has a viscosity ranging from 1 to 20 cSt when tested according to ASTM D445 at 100° C. Alternatively, the viscosity of the base oil may range from 3 to 17, or from 5 to 14, cSt, when tested according to ASTM D445 at 100° C.

The base oil may be further defined as a crankcase lubrication oil for spark-ignited and compression ignited internal combustion engines, including automobile and truck engines, two-cycle engines, aviation piston engines, and marine and railroad diesel engines. Alternatively, the base oil can be further defined as an oil to be used in gas engines, stationary power engines, and turbines. The base oil may be further defined as heavy or light duty engine oil.

In still other embodiments, the base oil may be further defined as synthetic oil which may include one or more alkylene oxide polymers and interpolymers and derivatives thereof wherein their terminal hydroxyl groups are modified by esterification, etherification, or similar reactions. Typically, these synthetic oils are prepared through polymerization of ethylene oxide or propylene oxide to form polyoxyalkylene polymers which can be further reacted to form the oils. For example, alkyl and aryl ethers of these polyoxyalkylene polymers (e.g., methylpolyisopropylene glycol ether having an average molecular weight of 1,000; diphenyl ether of polyethylene glycol having a molecular weight of 500-1,000; and diethyl ether of polypropylene glycol having a molecular weight of 1,000-1,500) and/or mono- and polycarboxylic esters thereof (e.g. acetic acid esters, mixed $C_3$-$C_8$ fatty acid esters, or the $C_{13}$ oxo acid diester of tetraethylene glycol) may also be utilized as the base oil.

The lubricant composition may be a low SAPS oil including less than 3, less than 1, or less than 0.5, wt. %, sulfated ash based on the total weight of the lubricant composition.

The base oil is typically present in the lubricant composition in an amount ranging from 70 to 99.9, from 80 to 99.9, from 90 to 99.9, or from 85 to 95, wt. %, based on the total weight of the lubricant composition. Alternatively, the base oil may be present in the lubricant composition in amounts of greater than 70, 80, 90, 95, or 99, wt. %, based on the total weight of the lubricant composition. In various embodiments, the amount of base oil in the lubricant composition (including diluents or carrier oils present) is from 80 to 99.5, from 85 to 96, or from 90 to 95, wt. %, based on the total weight of the lubricant composition.

Alternatively, the base oil may be present in the lubricant composition in an amount ranging from 0.1 to 50, from 1 to 25, or from 1 to 15, wt. %, based on the total weight of the lubricant composition.

The lubricant composition may additionally include one or more additives to improve various chemical and/or physical properties of the lubricant composition. Specific examples of the one or more additives include anti-wear additives, antioxidants, metal deactivators (or passivators), rust inhibitors, viscosity index improvers, pour point depressors, dispersants, detergents, and antifriction additives. Each of the additives may be used alone or in combination. The additive(s) can be used in various amounts, if employed. The lubricant composition may be formulated with the additional of several auxiliary components to achieve certain performance objectives for use in certain applications. For example, the lubricant composition may be a rust and oxidation formulation, a hydraulic formulation, turbine oil, and an internal combustion engine formulation.

If employed, the anti-wear additive can be of various types. In one embodiment, the anti-wear additive is a dihydrocarbyl-dithio phosphate salt, such as zinc dialkyldithiophosphate. The dihydrocarbyl-dithio phosphate salt may be represented by the following general formula: $[R^4O(R^5O)PS(S)]_2M$, wherein $R^4$ and $R^5$ are each independently hydrocarbyl groups having from 1 to 20 carbon atoms, and wherein M is a metal atom or an ammonium group. For example, $R^4$ and $R^5$ are each independently $C_{1-20}$ alkyl groups, $C_{2-20}$ alkenyl groups, $C_{3-20}$ cycloalkyl groups, $C_{1-20}$ aralkyl groups or $C_{3-20}$ aryl groups. The metal atom is selected from the group including aluminum, lead, tin, manganese, cobalt, nickel, or zinc. The ammonium group may be derived from ammonia or a primary, secondary, or tertiary amine. The ammonium group may be of the formula $R^6R^7R^8R^9N^+$, wherein $R^6$, $R^7$, $R^8$, and $R^9$ each independently designates a hydrogen atom or a hydrocarbyl group having from 1 to 150 carbon atoms. In certain embodiments, $R^6$, $R^7$, $R^8$, and $R^9$ may each independently designate hydrocarbyl groups having from 4 to 30 carbon atoms.

Alternatively, the anti-wear additive may include sulfur, phosphorus, and/or halogen containing compounds, e.g., sulfurised olefins and vegetable oils, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl)phosphorothioate and mixtures thereof (for example tris(isononylphenyl)phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis(2-ethylhexyl)aminomethyl]-2-mercapto-1H-1,3-benzothiazole, ethoxycarbonyl-5-octyldithio carbamate, and/or combinations thereof.

If employed, the anti-wear additive can be used in various amounts. The anti-wear additive is typically present in the lubricant composition in an amount ranging from 0.1 to 20, 0.5 to 15, 1 to 10, 0.1 to 1, 0.1 to 0.5, or 0.1 to 1.5, wt. %, based on the total weight of the lubricant composition. Alternatively, the anti-wear additive may be present in amounts of less than 20, less than 10, less than 5, less than 1, or less than 0.1, wt. %, based on the total weight of the lubricant composition. The anti-wear additive may be present in the additive concentrate in an amount ranging from 0.1 to 99, from 1 to 70, from 5 to 50, or from 25 to 50, wt. %, each based on the total weight of the additive concentrate.

If employed, the antioxidant can be of various types. Suitable antioxidants include alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Further examples of suitable antioxidants includes alkylthiomethylphenols, for example 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl)adipate, and combinations thereof, may also be utilized.

Furthermore, hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl)disulfide, and combinations thereof, may also be used.

It is also contemplated that alkylidenebisphenols, for example 2,2'-methylenebis(6-tert-butyl-4-methylphenol), 2,2'-methylenebis(6-tert-butyl-4-ethylphenol), 2,2'-methylenebis[4-methyl-6(α-methylcyclohexyl)phenol], 2,2'-methylenebis(4-methyl-6-cyclohexylphenol), 2,2'-methylenebis (6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis [6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol),1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercapto butane, ethylene glycol bis[3,3-bis(3'-tert-butyl-4'-hydroxyphenyl) butyrate], bis(3-tert-butyl-4-hydroxy-5'-methyl-phenyl)dicyclopentadiene, bis[2-tert-butyl-2'-hydroxy-5-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants in the lubricant composition.

O—, N—and S-benzyl compounds, for example 3,5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,3,3-tetramethylbutyl)phenyl]-2,2-bis(3,5-di-tert-butyl-4-hydroxybenzyl) malonate, and combinations thereof are also suitable for use as antioxidants.

Triazine compounds, for example 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris(3,5-di-tert-butyl-4-hydroxyphenyl propionyl)-hexahydro-1,3,5-triazine, 1,3,5-tris-(3,5-dicyclohexyl-4-hydroxybenzyl)-isocyanurate, and combinations thereof, may also be used.

Additional examples of antioxidants include aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl) phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl3,5-di-tert-butyl-4-hydroxybenzylphosphonate, dioctadecyl-5-tert-butyl-4-hydroxy3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example 4-hydroxylauranilide, 4-hydroxystearanilide, octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis (hydroxyethyl)oxamide, 3-thiaundecanol, 3-thiapentadecanol, trimethylhexanediol, trimethylolpropane, 4-hydroxymethyl-1-phospha-2,6,7-trioxabicyclo [2.2.2]octane, and combinations thereof, may also be used. It is further contemplated that esters of β-(5-tert-butyl-4-hydroxy-3-methylphenyl)-propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl)isocyanurate, N,N'-bis(hydroxyethyl) oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may be used.

Additional examples of suitable antioxidants include those that include nitrogen, such as amides of β-(3,5-di-tert-butyl-4-hydroxyphenyl)propionic acid e.g. N,N'-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine. Other suitable examples of antioxidants include aminic antioxidants such as N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'-diaminodiphenylmethane, 4,4'-diaminodiphenylmethane, N,N,N',N'-tetramethyl-4,4'-diaminodiphenylmethane, 1,2-bis[2-methyl-phenyl)amino]ethane, 1,2-bis(phenylamino)propane, (o-tolyl)biguanide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N'-tetraphenyl-1,4-diaminobut-2-ene, N,N-bis(2,2,6,6-tetramethylpiperid-4-yl-hexamethylenediamine, bis(2,2,6,6-tetramethyl piperid-4-yl)sebacate, 2,2,6,6-tetramethylpiperidin-4-one and 2,2,6,6-tetramethyl piperidin-4-ol, and combinations thereof.

Even further examples of suitable antioxidants include aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1trithiatridecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used.

If employed, the antioxidant can be used in various amounts. The antioxidant is typically present in the lubricant composition in an amount ranging from 0.01 to 5, 0.1 to 3, or 0.5 to 2 wt. % based on the total weight of the lubricant composition. Alternatively, the antioxidant may be present in amounts of less than 5, less than 3, or less than 2, wt. %, based on the total weight of the lubricant composition. The antioxidant may be present in the additive concentrate in an amount ranging from 0.1 to 99, from 1 to 70, from 5 to 50, or from 25 to 50, wt. %, based on the total weight of the additive concentrate.

If employed, the metal deactivator can be of various types. Suitable metal deactivators include benzotriazoles and derivatives thereof, for example, 4- or 5-alkylbenzotriazoles (e.g., tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl)tolutriazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl)tolutriazole, and combinations thereof.

Additional examples of suitable metal deactivators include 1,2,4-triazoles and derivatives thereof, for example 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4,4'-methylenebis(2-undecyl-5-methylimidazole) and bis[(N-methyl)imidazol-2-yl]carbinol octyl ether, and combinations thereof. Further examples of suitable metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further examples of metal deactivators include amino compounds, for example salicylidenepropylenediamine, salicylaminoguanidine and salts thereof, and combinations thereof.

If employed, the metal deactivator can be used in various amounts. The metal deactivator is typically present in the lubricant composition in an amount ranging from 0.01 to 0.1, 0.05 to 0.01, or 0.07 to 0.1, wt. %, based on the total weight of the lubricant composition. Alternatively, the metal deactivator may be present in amounts of less than 0.1, less than 0.7, or less than 0.5, wt. %, based on the total weight of the lubricant composition. The metal deactivator may be present in the additive concentrate in an amount ranging from 0.1 to 99, from 1 to 70, from 5 to 50, or from 25 to 50, wt. %, based on the total weight of the additive concentrate.

If employed, the rust inhibitor and/or friction modifier can be of various types. Suitable examples of rust inhibitors and/or friction modifiers include organic acids, their esters, metal salts, amine salts and anhydrides, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy)acetic acid and the amine salts thereof, and also N-oleoylsarcosine, sorbitan monooleate, lead naphthenate, alkenylsuccinic anhydrides, for example dodecenylsuccinic anhydride, 2-carboxymethyl-1-dodecyl-3-methylglycerol and the amine salts thereof, and combinations thereof. Additional examples include nitrogen-containing compounds, for example, primary, secondary or tertiary aliphatic or cycloaliphatic amines and amine salts of organic and inorganic acids, for example oil-soluble alkylammonium carboxylates, and also 1-[N,N-bis(2-hydroxyethyl)amino]-3-(4-nonylphenoxy) propan-2-ol, and combinations thereof. Further examples include heterocyclic compounds, for example: substituted imidazolines and oxazolines, and 2-heptadecenyl-1-(2-hydroxyethyl)imidazoline, phosphorus-containing compounds, for example: amine salts of phosphoric acid partial esters or phosphonic acid partial esters, and zinc dialkyldithiophosphates, molybdenum-containing compounds, such as molydbenum dithiocarbamate and other sulphur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl)glycerols and 2-carboxyalkyl-1,3-dialkylglycerols, and combinations thereof.

If employed, the rust inhibitor and/or friction modifier can be used in various amounts. The rust inhibitor and/or friction modifier is typically present in the lubricant composition in an amount ranging from 0.01 to 0.1, 0.05 to 0.01, or 0.07 to 0.1, wt. %, based on the total weight of the lubricant composition. Alternatively, the rust inhibitor and/or friction modifier may be present in amounts of less than 0.1, less than 0.7, or less than 0.5, wt. %, based on the total weight of the lubricant composition. The rust inhibitor and/or friction modifier may be present in the additive concentrate in an amount ranging from 0.01 to 0.1, from 0.05 to 0.01, or from 0.07 to 0.1, wt. %, based on the total weight of the additive concentrate.

If employed, the viscosity index improver (VII) can be of various types. Suitable examples of VIIs include polyacrylates, polymethacrylates, vinylpyrrolidone/methacrylate copolymers, polyvinylpyrrolidones, polybutenes, olefin copolymers, styrene/acrylate copolymers and polyethers, and combinations thereof. If employed, the VII can be used in various amounts. The VII is typically present in the lubricant composition in an amount ranging from 0.01 to 20, 1 to 15, or 1 to 10, wt. %, based on the total weight of the lubricant composition. Alternatively, the VII may be present in amounts of less than 10, less than 8, or less than 5, wt. %, based on the total weight of the lubricant composition. The VII may be present in the additive concentrate in an amount ranging from 0.01 to 20, from 1 to 15, or from 1 to 10, wt. %, based on the total weight of the additive concentrate.

If employed, the pour point depressant can be of various types. Suitable examples of pour point depressants include polymethacrylate and alkylated naphthalene derivatives, and combinations thereof.

If employed, the pour point depressant can be used in various amounts. The pour point depressant is typically present in the lubricant composition in an amount ranging from 0.01 to 0.1, 0.05 to 0.01, or 0.07 to 0.1, wt. %, based on the total weight of the lubricant composition. Alternatively, the pour point depressant may be present in amounts of less than 0.1, less than 0.7, or less than 0.5, wt. %, based on the total weight of the lubricant composition. The pour point depressant may be present in the additive concentrate in an amount ranging from 0.1 to 99, from 1 to 70, from 5 to 50, or from 25 to 50, wt. %, based on the total weight of the additive concentrate.

If employed, the dispersant can be of various types. Suitable examples of dispersants include polybutenylsuccinic amides or -imides, polybutenylphosphonic acid derivatives and basic magnesium, calcium and barium sulfonates and phenolates, succinate esters and alkylphenol amines (Mannich bases), and combinations thereof.

The amine dispersant may be a polyalkene amine. The polyalkene amine includes a polyalkene moiety. The polyalkene moiety is the polymerization product of identical or different, straight-chain or branched $C_{2-6}$ olefin monomers. Examples of suitable olefin monomers are ethylene, propylene, 1-butene, isobutene, 1-pentene, 2-methylbutene, 1-hexene, 2-methylpentene, 3-methylpentene, and 4-methylpentene. The polyalkene moiety has a number average molecular weight Mn ranging from 200 to 10,000.

In one configuration, the polyalkene amine is derived from a polyisobutene. Particularly suitable polysiobutenes are known as "highly reactive" polyisobutenes which feature a high content of terminal double bonds. Suitable highly reactive polyisobutenes are, for example, polyisobutenes which have a fraction of terminal vinylidene double bonds of greater than 70 mol %, greater than 80 mol %, greater than 85 mol %, greater than 90 mol %, or greater than 92 mol %, based on the total number of double bonds in the polyisobutene. Further preference is given in particular to polyisobutenes which have uniform polymer frameworks. Uniform polymer frameworks are those polyisobutenes which are composed of at least 85, 90, or 95, wt. %, of isobutene units. Such highly reactive polyisobutenes preferably have a number-average molecular weight in the above mentioned range. In addition, the highly reactive polyisobutenes may have a polydispersity ranging from 1.05 to 7, or from 1.1 to 2.5. The highly reactive polyisobutenes may have a polydispersity less than 1.9, or less than 1.5. Polydispersity refers to the quotients of weight-average molecular weight Mw divided by the number-average molecular weight Mn.

The polyalkene amine may include moieties derived from succinic anhydride and may include hydroxyl and/or amino and/or amido and/or imido groups. For example, the amine dispersant may be derived from polyisobutenylsuccinic anhydride which is obtainable by reacting conventional or highly reactive polyisobutene having a number average molecular weight ranging from 300 to 5000 with maleic anhydride by a thermal route or via chlorinated polyisobutene. Particular interest attaches to derivatives with aliphatic polyamines such as ethylenediamine, diethylenetriamine, triethylenetetramine or tetraethylenepentamine.

To prepare the polyalkene amine, the polyalkene component may be aminated in a manner known per se. A preferred process proceeds via the preparation of an oxo intermediate by hydroformylation and subsequent reductive amination in the presence of a suitable nitrogen compound.

The amine dispersant may be represented by the general formula: $HNR^{10}R^{11}$, where $R^{10}$ and $R^{11}$ may each independently be a hydrogen atom or a hydrocarbyl group having from 1 to 17 carbon atoms, or analogs thereof which have been mono- or polyhydroxylated. The amine dispersant may also be a poly(oxyalkyl) radical or a polyalkylene polyamine radical of the general formula Z—NH—($C_1$-$C_6$-alkylene-NH)$_m$—$C_1$-$C_6$-alkylene, where m is an integer ranging from 0 to 5, Z is a hydrogen atom or a hydrocarbyl group having from 1 to 6 carbon atoms with $C_1$-$C_6$ alkylene representing the corresponding bridged analogs of the alkyl radicals. The amine dispersant may also be a polyalkylene imine radical composed of from 1 to 10 $C_1$-$C_4$ alkylene imine groups; or, together with the nitrogen atom to which they are bonded, are an optionally substituted 5-to 7-membered heterocyclic ring which is optionally substituted by from one to three $C_1$-$C_4$ alkyl radicals and optionally bears one further ring heteroatom, such as O or N.

Examples of suitable alkyl radicals include straight-chain or branched radicals having from 1 to 18 carbon atoms, such as methyl, ethyl, iso- or n-propyl, n-, iso-, sec- or tert-butyl, n- or isopentyl; and also n-hexyl, n-heptyl, n-octyl, n-nonyl, n-decyl, n-undecyl, n-tridecyl, n-tetradecyl, n-pentadecyl, n-hexadecyl and n-octadecyl, and also the mono- or polybranched analogs thereof; and also corresponding radicals in which the hydrocarbon chain has one or more ether bridges.

Examples of suitable alkenyl radicals include mono- or polyunsaturated, preferably mono- or di-unsaturated analogs of alkyl radicals has from 2 to 18 carbon atoms, in which the double bonds may be in any position in the hydrocarbon chain.

Examples of $C_4$-$C_{18}$ cycloalkyl radical include cyclobutyl, cyclopentyl and cyclohexyl, and also the analogs thereof substituted by from 1 to 3 $C_1$-$C_4$ alkyl radicals: The $C_1$-$C_4$ alkyl radicals are, for example, selected from methyl, ethyl, iso- or n-propyl, n-, iso-, sec- or tert-butyl.

Examples of the arylalkyl radical include a $C_1$-$C_{18}$ alkyl group and an aryl group which are derived from a monocyclic or bicyclic, 4-to 7-membered, in particular, 6 membered aromatic or heteroaromatic group, such as phenyl, pyridyl, naphthyl and biphenyl.

Examples of suitable compounds of the general formula $HNR^{10}R^{11}$ are: ammonia; primary amines such as methylamine, ethylamine, n-propylamine, isopropylamine, n-butylamine, isobutylamine, sec-butylamine, tert-butylamine, pentylamine, hexylamine, cyclopentylamine and cyclohexylamine; primary amines of the formulas: $CH_3$—O—$C_2H_4$—$NH_2$, $C_2H_5$—O—$C_2H_4$—$NH_2$, $CH_3$—O—$C_3H_6$—$NH_2$, $C_2H_5$—O—$C_3H_6$—$NH_2$, $C_4H_9$—O—$C_4H_8$—$NH_2$, HO—$C_2H_4$—$NH_2$, HO—$C_3H_6$—$NH_2$ and HO—$C_4H_8$—$NH_2$; secondary amines, for example dimethylamine, diethylamine, methylethyl amine, di-n-propyl amine, diisopropylamine, diisobutylamine, di-sec-butylamine, di-tert-butylamine, dipentylamine, dihexylamine, dicyclopentylamine, dicyclohexylamine and diphenylamine; and also secondary amines of the formulas: $(CH_3—O—C_2H_4)_2NH$, $(C_2H_5—O—C_2H_4)_2NH$, $(CH_3—O—C_3H_6)_2NH$, $(C_2H_5—O—C_3H_6)_2NH$, $(n\text{-}C_4H_9—O—C_4H_8)_2NH$, $(HO—C_2H_4)_2NH$, $(HO—C_3H_6)_2NH$ and $(HO—C_4H_8)_2NH$; and heterocyclic amines, such as pyrrolidine, piperidine, morpholine and piperazine, and also their substituted derivatives, such as $N—C_{1-6}$ alkylpiperazines and dimethylmorpholine; and polyamines and polyimines, such as n-propylenediamine, 1,4-butanediamine, 1,6-hexanediamine, diethylenetriamine, triethylenetetramine and polyethylene imines, and also their alkylation products, for example 3-(dimethylamino)-n-propylamine, N,N-dimethylethylenediamine, N,N-diethylethylenediamine and N,N,N',N'-tetramethyldiethylenetriamine.

If employed, the dispersant can be used in various amounts. The dispersant is typically present in the lubricant composition in an amount ranging from 0.01 to 15, 0.1 to 12, 0.5 to 10, or 1 to 8, wt. %, based on the total weight of the lubricant composition. Alternatively, the dispersant may be present in amounts of less than 15, less than 12, less than 10, less than 5, or less than 1, wt. %, based on the total weight of the lubricant composition. These dispersants may be present in the additive concentrate in an amount ranging from 0.1 to 99, from 1 to 70, from 5 to 50, or from 25 to 50, wt. %, based on the total weight of the additive concentrate.

If employed, the detergent can be of various types. Suitable examples of detergents include overbased or neutral metal sulphonates, phenates and salicylates, and combinations thereof.

If employed, the detergent can be used in various amounts. The detergent is typically present in the lubricant composition in an amount ranging from 0.01 to 5, 0.1 to 4, 0.5 to 3, or 1 to 3, wt. %, based on the total weight of the lubricant composition. Alternatively, the detergent may be present in amounts of less than 5, less than 4, less than 3, less than 2, or less than 1, wt. %, based on the total weight of the lubricant composition. The detergent is typically present in the additive concentrate in an amount ranging from 0.1 to 99, from 1 to 70, from 5 to 50, or from 25 to 50, wt. %, based on the total weight of the additive concentrate.

In various embodiments, the lubricant composition is substantially free of water, e.g., the lubricant composition includes less than 5, less than 1, less than 0.5, or less than 0.1, wt. %, of water based on the total weight of the lubricant composition. Alternatively, the lubricant composition may be completely free of water.

Some of the compounds described above may interact in the lubricant composition, such that the components of the lubricant composition in final form may be different from those components that are initially added or combined together. Some products formed thereby, including products formed upon employing the lubricant composition of this invention in its intended use, are not easily described or describable. Nevertheless, all such modifications, reaction products, and products formed upon employing the lubricant composition of this invention in its intended use, are expressly contemplated and hereby included herein. Various embodiments of this invention include one or more of the modification, reaction products, and products formed from employing the lubricant composition, as described above.

A method of lubricating a system including a fluoropolymer seal is also provided. The method includes contacting the fluoropolymer seal with the acyclic amine compound described above. The acyclic amine compound may be dissolved in the base oil, and as such, the method may include contacting the fluoropolymer seal with the lubricant composition. The system including the fluoropolymer seal may include an internal combustion engine. Alternatively, the system including the fluoropolymer seal may include any device where lubricant compositions are used, such as conveyors, transmissions, diesel engines, gearings, pulleys, and other machinery.

Further, a method of forming the lubricant composition is provided. The method includes combining the base oil and the acyclic amine compound described above. Thus, the amine compound can be added directly to the base oil by dispersing or dissolving it in the base oil at the desired level of concentration. Alternatively, the base oil may be added directly to the amine compound in conjunction with agitation until the amine compound is provided at the desired level of concentration. Such blending may occur at ambient or elevated temperatures. In one embodiment, one or more of the additives are blended into a concentrate that is subsequently blended into the base oil to make the lubricant composition. The concentrate will typically be formulated to provide the desired concentration in the lubricant composition when the concentrate is combined with a predetermined amount of base oil.

EXAMPLES

A fully formulated lubricating oil composition containing dispersant, detergent, aminic antioxidant, phenolic antioxidant, anti-foam, base oil, antiwear additive, pour point depressant and viscosity modifier was prepared. This lubricant composition, which is representative of a commercial crankcase lubricant, is designated as the "reference lubricant" and used as a baseline to compare the effects of different amine compounds on seal compatibility.

The reference lubricant was combined with various different aminic compounds to determine the effect of the aminic compounds on seal compatibility. Inventive Example #1 includes the amine compound of the present invention according to one embodiment. Comparative Examples #1-3 include other aminic compounds falling outside the scope of the present invention.

The compound added to the reference lubricant in Inventive Example #1 is tert-amyl-tert-butylamine. The compound added to the reference lubricant in Comparative Example #1 is 1-dodecylamine; the compound added to the reference lubricant in Comparative Example #2 is N—N-dimethylcyclohexylamine; and the compound added to the reference lubricant in Comparative Example #3 is 4-benzylpiperidine.

Each aminic additive was added in an amount sufficient to provide 3 units of TBN over the TBN of the reference lubricant. The TBN of each of the resulting samples was determined in accordance with each of ASTM D4739 and ASTM D2896 (in units of mg KOH/g). An additional amount of base oil was added to each of the samples to provide comparable total mass. The amounts of the reference lubricant and added compounds for each of the Inventive and Comparative Examples are shown in Table 1 below:

TABLE 1

Formulations of Inventive and Comparative Examples

| | Reference Lubricant | Inventive #1 | Comparative #1 | Comparative #2 | Comparative #3 |
|---|---|---|---|---|---|
| Reference Lubricant (g) | 94.00 | 94.00 | 94.00 | 94.00 | 94.00 |
| Additional Base Oil (g) | 6 | 5.11 | 4.76 | 5.06 | 4.88 |
| tert-amyl-tert-butylamine (g) | — | 0.89 | — | — | — |
| 1-dodecylamine (g) | — | — | 1.24 | — | — |
| N-N-dimethylcyclohexylamine (g) | — | — | — | 0.94 | — |
| 4-benzylpiperidine (g) | — | — | — | — | 1.12 |
| Total Weight (g) | 100.00 | 100.00 | 100.00 | 100.00 | 100.00 |
| Additional TBN | — | 3 | 3 | 3 | 3 |

The seal compatibility of the inventive and comparative examples was evaluated using an industry-standard CEC L-39-T96 seal compatibility test. The CEC-L-39-T96 seal compatibility test is performed by submitting the seal or gaskets in the lubricant composition, heating the lubricant composition with the seal contained therein to an elevated temperature, and maintaining the elevated temperature for a period of time. The seals are then removed and dried, and the mechanical properties of the seal are assessed and compared to the seal specimens which were not heated in the lubricant composition. The percent change in these properties is analyzed to assess the compatibility of the seal with the lubricant composition. Each formulation was tested twice (Run #1 and Run #2) under the same conditions. The results of the seal compatibility test are shown below in Tables 2 and 3.

TABLE 2

Seal Compatibility Test Results (Run 1)

| | Reference Lubricant | Inventive #1 | Comparative #1 | Comparative #2 | Comparative #3 |
|---|---|---|---|---|---|
| Volume Change (%) | 0.5 | 0.6 | 15.7 | 0 | 3 |
| Points Hardness DIDC | 0 | 2 | 0 | 6 | 3 |
| Tensile Strength (%) | −3 | −44 | −64 | −75 | −70 |
| Elongation at Rupture (%) | −15 | −67 | −100 | −82 | −75 |

TABLE 3

Seal Compatibility Test Results (Run 2)

| | Reference Lubricant | Inventive #1 | Comparative #1 | Comparative #2 | Comparative #3 |
|---|---|---|---|---|---|
| Volume Change (%) | 0.5 | 0.6 | 15.4 | −0.1 | 2.9 |
| Points Hardness | 0 | 3 | −1 | 0.6 | 3 |
| Tensile Strength | −6 | −49 | −70 | −75 | −69 |

TABLE 3-continued

Seal Compatibility Test Results (Run 2)

| | Reference Lubricant | Inventive #1 | Comparative #1 | Comparative #2 | Comparative #3 |
|---|---|---|---|---|---|
| Elongation at Rupture | −10 | −71 | −98 | −78 | −76 |

As shown in Tables 2 and 3, the seal compatibility of the Inventive Example #1 was improved in terms of tensile strength and elongation at rupture as compared to the seal compatibility of Comparative Examples #1-3. More particularly, the tensile strength of Inventive Example #1 was −44 and −49%, whereas the tensile strength of Comparative Examples #1, 2, 3, was −64 and −70; −75 and −75, and −70 and −69, respectively. Similarly, the elongation at rupture for Inventive Example #1 was −67 and −71%, whereas the elongation at rupture of Comparative Examples #1, 2, 3, was −100 and −98; −82 and −78, and −75 and −76, respectively.

This testing shows that the compositions of Comparative Examples #1-3 degraded the tensile strength and elongation at rupture of the fluoroelastomer seal to a much greater degree than the composition of Inventive Example #1.

The TBN of each of the aminic compounds (inventive and comparative) was determined in accordance with each of ASTM D4739 (in units of mg KOH/g). The results are shown in Table 4 below.

TABLE 4

TBN of Neat Amine Compounds

| | Inventive #1 | Comparative #1 | Comparative #2 | Comparative #3 |
|---|---|---|---|---|
| TBN (mg KOH/g) by ASTM D4739 | 305 | 295 | 367 | 312 |

As shown in Tables 2-4, although Inventive Example #1 demonstrated a median TBN value relative the TBN values of the Comparative Examples #1-3, the seal compatibility of the Inventive Example #1 was much improved in terms of tensile strength and elongation at rupture.

It is to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and/or in combination and provides adequate support for specific embodiments within the scope of the appended claims.

It is also to be understood that any ranges and subranges relied upon in describing various embodiments of the present invention independently and collectively fall within the scope of the appended claims and are understood to describe and contemplate all ranges, including whole and/or fractional values therein, even if such values are not expressly written herein. One of skill in the art readily recognizes that the enumerated ranges and subranges sufficiently describe and enable various embodiments of the present invention and such ranges and subranges may be further delineated into relevant halves, thirds, quarters, fifths, and so on. As just one example, a range "of from 0.1 to 0.9" may be further delineated into a lower third, i.e. , from 0.1 to 0.3, a middle third, i.e., from 0.4 to 0.6, and an upper third, i.e., from 0.7 to 0.9, which individually and collectively are within the scope of the appended claims and may be relied upon individually and/or collectively and provide adequate support for specific embodiments within the scope of the appended claims.

In addition, with respect to the language which defines or modifies a range, such as "at least," "greater than," "less than," "no more than," and the like, it is to be understood that such language includes subranges and/or an upper or lower limit As another example, a range of "at least 10" inherently includes a subrange of from at least 10 to 35, a subrange of from at least 10 to 25, a subrange from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner and it is to be understood that the terminology which has been used is intended to be in the nature of words of description rather than of limitation. Many modifications and variations of the present invention are possible in light of the above teachings and the invention may be practiced otherwise than as specifically described.

What is claimed is:

1. A crankcase lubricant composition comprising:

a base oil; and an acyclic amine compound present in an amount ranging from 0.1 to 10 wt. % based a total weight of said crankcase lubricant composition, said acyclic amine compound having a formula (I):

(I)

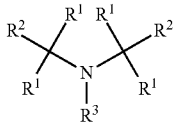

where each $R^1$ is an independently selected alkyl group having from 1 to 8 carbon atoms, where each $R^2$ is an independently selected alkyl group having from 1 to 8 carbon atoms, and where $R^3$ is selected from hydrogen and an alcohol group, an alkyl group, an amide group, an ether group, and an ester group, each having from 1 to 17 carbon atoms.

2. A crankcase lubricant composition according to claim 1 wherein said acyclic amine compound is non-polymeric and has a weight average molecular weight ranging from 100 to 1200.

3. A crankcase lubricant composition according to claim 1 where said acyclic amine compound has a weight average molecular weight ranging from 200 to 800.

4. A crankcase lubricant composition according to claim 1 wherein $R^3$ is an alkyl group having from 1 to 4 carbon atoms.

5. A crankcase lubricant composition according to claim 1 wherein said acyclic amine compound has a TBN value of at least 70 mg KOH per g of said acyclic amine compound when tested according to ASTM D4739.

6. A crankcase lubricant composition according to claim 1 comprising less than 0.1 wt. % of compounds which would react with said acyclic amine compound based on the total weight of said lubricant composition.

7. A crankcase lubricant composition according to claim 1 wherein said base oil is selected from an API Group I Oil, an API Group II Oil, an API Group III Oil, an API Group IV Oil, and combinations thereof, and wherein said base oil has a viscosity ranging from 1 to 20 cSt when tested at 100° C. according to ASTM D445.

8. A crankcase lubricant composition according to claim 1 wherein at least 90 wt. % of said acyclic amine compound remains unreacted in said lubricant composition based on a total weight of said acyclic amine compound utilized to form said lubricant composition prior to any reaction in said lubricant composition.

9. A method of lubricating a system comprising a fluoropolymer seal with a crankcase lubricant composition which comprises a base oil and an acyclic amine compound present in an amount ranging from 0.1 to 10 wt. % based a total weight of said crankcase lubricant composition, said method comprising:

contacting the fluoropolymer seal with the crankcase lubricant composition, wherein the acyclic amine compound has a formula (I):

(I)

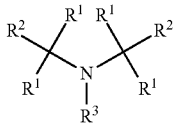

where each $R^1$ is an independently selected alkyl group having from 1 to 8 carbon atoms, where each $R^2$ is an independently selected alkyl group having from 1 to 8 carbon atoms, and where $R^3$ is selected from hydrogen and an alcohol group, an alkyl group, an amide group, an ether group, and an ester group, each having from 1 to 17 carbon atoms.

10. An additive concentrate for a crankcase lubricant composition comprising:

an anti-wear additive comprising sulfur and/or phosphorus; and an acyclic amine compound present in an amount ranging from 0.5 to 90 wt. % based a total weight of said additive concentrate, said acyclic amine compound having a formula (I):

(I)

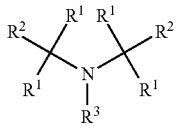

where each $R^1$ is an independently selected alkyl group having from 1 to 8 carbon atoms, where each $R^2$ is an independently selected alkyl group having from 1 to 8 carbon atoms, and where $R^3$ is selected from hydrogen and an alcohol group, an alkyl group, an amide group, an ether group, and an ester group, each having from 1 to 4 carbon atoms.

11. An additive concentrate according to claim 10 wherein said acyclic amine compound is non-polymeric and has a weight average molecular weight ranging from 100 to 1200.

12. An additive concentrate according to claim 10 further comprising a dispersant.

13. An additive concentrate according to claim 10 wherein said acyclic amine compound has a weight average molecular weight ranging from 200 to 800.

14. An additive concentrate according to claim 10 wherein $R^3$ is an alkyl group having from 1 to 4 carbon atoms.

15. An additive concentrate according to claim 10 wherein said acyclic amine compound has a TBN value of at least 70 mg KOH per g of said acyclic amine compound when tested according to ASTM D4739.

16. An additive concentrate according to claim 10 further comprising an anti-wear additive.

* * * * *